United States Patent [19]

Scheminger et al.

[11] Patent Number: 4,813,143

[45] Date of Patent: Mar. 21, 1989

[54] HANDLE AND KNIVES COMPRISING THE SAME

[75] Inventors: William J. Scheminger, Olean, N.Y.; Dan W. Harrison, Brownsboro, Tex.

[73] Assignee: Alcas Cutlery Corporation, Olean, N.Y.

[21] Appl. No.: 66,778

[22] Filed: Jun. 25, 1987

[51] Int. Cl.[4] ..... B26B 1/08; B26B 1/10

[52] U.S. Cl. ..... 30/335; 30/337; 16/114 R; 16/DIG. 12

[58] Field of Search ..... 30/162, 330, 329, 335, 30/337, 339; 16/114 R, 114 A, 116 R, 116 A, DIG. 12

[56] References Cited

U.S. PATENT DOCUMENTS

| | | | |
|---|---|---|---|
| 485,236 | 11/1892 | Steinle | 30/337 X |
| 1,340,476 | 5/1920 | D'Aquin | 16/DIG. 12 X |
| 1,609,117 | 11/1926 | Hansen | 16/DIG. 12 X |
| 2,671,962 | 3/1954 | Spurzen | 30/337 X |
| 2,975,505 | 3/1961 | Linskey et al. | 16/114 R X |
| 3,172,439 | 3/1965 | Fischer | 16/114 R X |
| 4,011,657 | 3/1977 | Vance | 30/337 |
| 4,567,616 | 2/1986 | Lyons | 16/116 R X |

*Primary Examiner*—Donald R. Schran
*Assistant Examiner*—Michael D. Folkerts
*Attorney, Agent, or Firm*—Ladas & Parry

[57] ABSTRACT

A handle, suitable for knives and other implements, which provides for adjustable length blades, etc. comprises an outer portion of a resilient high coefficient of friction material surrounding an inner chamber of more rigid low coefficient of friction material into which a blade tang or the like may fit. The chamber is configured such that the high coefficient of friction material may be forced into close contact with a blade tang or the like to fix this in variety of different portions.

15 Claims, 4 Drawing Sheets

HANDLE AND KNIVES COMPRISING THE SAME

In one aspect, the present invention relates to knives. More specifically, it relates to knives in which the length of the blade is adjustable and has particular reference to knives that are of use in outdoor applications such as fish filleting knives and camp knives and for indoor use as household or kitchen knives. In a second aspect, it relates to handles that are particularly useful for such knives, but may also have other used, for example, for chisel or spatula blades.

The general concept of knives of adjustable blade lengths is known. In recent years, such a concept has been used for providing for movement of blades in utility knives between operating and "safe" positions and in providing for strip blades in knives of that type to be extended so that dulled portions can be broken off. In some cases, such knives also provide for the blade to be moved between a retracted position and more than one extended cutting positions. Descriptions of knives of these types can be found, for example, in U.S. Pat. Nos. 2,870,537 (Ortner, Jan. 27, 1959), 3,708,881 (Bennett, Jan. 9, 1973), 3,765,089 (Ibata, Oct. 16, 1973), 3,879,847 (Roll, Apr. 29, 1975), 4,005,525 (Gringer, Feb. 1, 1977), 4,089,112 (Richards, May 16, 1978), 4,200,977 (Kageyama, et al, May 6, 1980), 4,242,975 (Rollband, et al Jan. 6, 1981) and 4,586,256 (Weimann May 6, 1986). Such knives are, however, in general of a type in which a short rigid blade is employed and cutting is normally of a "scoring" type using a point at the end of the blade.

The use of longer blades, that may also have a degree of flexibility, in knives providing for adjustable blade lengths has also been described in the art. U.S. Pat. No. 1,204,388 (Alver, Nov. 14, 1916) describes a knife with a hollow sheath handle into which the blade may be wholly or partially retracted. One side of the sheath has notches into which a strict mounted on one side of the blade may fit so as to adjust the length of the blade protruding from the sheath.

U.S. Pat. No. 1,960,130 (Trubel, May 22, 1934) describes a knife with a slot in one side of the handle through which a latch button mounted on the blade protrudes. The extension of the blade may be adjusted by movement of the latch button. The blade also has a resilient piece of metal spot welded to the other side of the blade to the latch button which urges the blade against the wall of the handle in which the slot exists so as to hold the blade in position. A somewhat similar knife is shown in U.S. Pat. No. 1,906,573 (Gits, May 2, 1933) except in the case the latch button is mounted on a resilient member.

U.S. Pat. No. 1,434,388 (O'Hughes, Nov. 7, 1922) is somewhat similar to U.S. Pat. No. 1,960,130, but lacks any resilient piece.

U.S. Pat. No. 1,622,870 (Hulse, Sept. 14, 1926) describes an adjustable length bladed knife in which the knife blade cooperates with teeth within the handle.

The use of a locking lug pin on a blade to render its extension from a handle adjustable is described in U.S. Pat. No. 2,074,640 (Christy, Mar. 23, 1937).

A screw mechanism for extending a knife blade is described in U.S. Pat. No. 2,243,030 (Fischer, May 20, 1941).

U.S. Pat. No. 2,270,655 (Keeran, Jan. 20, 1942) describes a variant on U.S. Pat. No. 1,960,130 in which locking of a blade in position is effected by a spring-actuated detent operated by an exterior projection in the form of a button.

U.S. Pat. No. 2,477,986 (Kennerly, Aug. 2, 1949) describes a knife which is adjustable by virtue of the action of a helical spring that surrounds a blade shank in the handle.

U.S. Pat. No. 2,601,402 (Krause, June 24, 1952) uses a metal liner having a slot aligned with a slot in the handle through which a lock key on the blade shank may pass to achieve adjustable blade length.

Essentially, similar ideas and refinements and modifications thereof are described in U.S. Pat. Nos. 2,735,176 (Costin, Feb. 21, 1956), 3,079,686 (Christy, Mar. 5, 1963), 3,863,339 (Reanney, Feb. 4, 1975), 4,170,062 (Machida, Oct. 9, 1979) and 4,630,373 (Slaurseth, Dec. 23, 1986).

U.S. Pat. No. 4,226,020 (Auenot, Oct. 7, 1980) describes a mechanism for locking and advancing a knife blade. The mechanism comprises a rectilinear blade-holding sheath with longitudinal slit having a series of notches on its lower edge, together with a slider to maintain the locking and the advance of the blade, said slider being molded in one piece of synthetic material comprising structures for supporting the blade, a means of elastic return, and a means of locking by a ratchet mechanism in the notches of shape blade-carrier.

The present invention utilizes a new concept to maintain the blade of an adjustable blade length knife in position while in use by employing a sliding chamber the surface of which is made of material having a relatively low coefficient of sliding friction with the metal of the blade within the handle, but arranging this chamber so that it does not extend to the "front end" of the handle so that a portion of the blade within the handle must at all times be outside the sliding chamber and using a resilient deformable material having a high coefficient of friction as the material with which the blade comes into contact in this region. Thus, simply grasping the handle in the region close to the "front end" thereof should be sufficient in many cases to hold the knife blade firmly in position since the finger pressure deforms the handle material to a sufficient extent extend that the high friction surface of the material contacts the blade and holds it in position.

According to the present invention, therefore, there is provided a knife having an adjustable blade length, said knife comprising a blade moveable within a handle within which handle is mounted a slide chamber the inner surface of which have a coefficient of sliding friction within the metal of the blade below 0.35, said handle further comprising a portion made of a deformable material having a coefficient of sliding friction with said blade of at least 0.55, said portion being disposed in such a way that when the handle is grasped it is urged into contact with said blade so as to hold said blade in position in use.

It will be appreciated that the portion of a blade that is within a handle of a knife is normally referred to as a tang. The tang is normally integrally formed with the portion of the blade that extends outside the handle when used herein where the context permits, the term "blade" includes the tang thereof.

Conveniently, said deformable material will form the bulk of the mass of the handle and will surround said sliding chamber, said sliding chamber being positioned with the handle so that it does not extend to the front end of the handle so that the blade must be able to contact said deformable material. Alternatively, the sliding chamber may be provided with cutouts positioned to correspond with the gripping position on the exterior of the handle.

Such handles may conveniently be made by injection molding the material for the bulk of the handle so as to surround the sliding chamber.

If desired, the ability of the fingers grip to the handle in such a way as to urge the high coefficient of friction material into contact with the blade may be augmented by a side-mounted toggle with a cam action that when in the "fixed" position urges the side of the blade against an area of the high coefficient of friction material.

The material used for the sliding chamber of knives according to the invention preferably has a coefficient of sliding friction below about 0.35, for example in the range about 0.15 to about 0.3. Suitable materials for the sliding chamber include glass filled high strength thermoplastic resins such as polyamide, and acetyl resins. Typically, although not necessarily, such resins will contain a fiber glass filler, for example, from 20 to 40%, typically about 30% by weight of fiber glass filler. One material we have found to be particularly useful is Zytel G82, 30% glass filled—Zytel is a trademark of EI Dupont de Nemours who produce this material.

The deformable high coefficient of friction material typically has a modulus of elasticity of less than 2,500 psi preferably in the range 1,500 to 2,000 and a coefficient of sliding friction of at least 0.55, preferably about 0.6. Typically, they are high coefficient of friction elastomers. Certain thermoplastic elastomers, especially some rubbers have a "sticky" feel to them. Such rubbers are particularly useful in forming the high-coefficient of friction position of the handle of knives of the present invention. One material we have found to be particularly useful is the rubber sold by Shell under the trademark "Kraton".

The blade may be made of any conventional metal blade material such as stainless or carbon steel.

Knives of the present invention are of particular use in applications where a flexible bladed knife is required, for example, for filleting of fish. In such an application, a single blade may be used in a knife, but adjusted to a number of positions corresponding, for example, to traditional filleting knives of from 6 to 9 inches or those of 4 to 7 inches. By use of a knife of the present invention, a fisherman has available in a single knife the means be requires for filleting a wide variety of fish such as may be caught in a single fishing expedition and does not need to carry with him a wide assortment of knives as has previously been the case.

From a second aspect, the invention provides a handle suitable for use in knives of this type, but also having other applications, said handle having an interior cavity accessible by an aperture at one end of said handle and having mounted therein a side-mounted toggle with a cam action that can urge the tang or shank of a blade or any similar tool into close contact with a portion of the surface of said interior cavity that is formed of a material having a coefficient of sliding friction with the material of said tang of at least 0.75.

Such handles are of use with a variety of tools wherein the work pieces may be interchangeable. Thus such handles may be of use for holding a variety of chisel blades or screw driver heads.

The invention will now be more specifically described with reference to the accompanying drawings.

Figure 6:
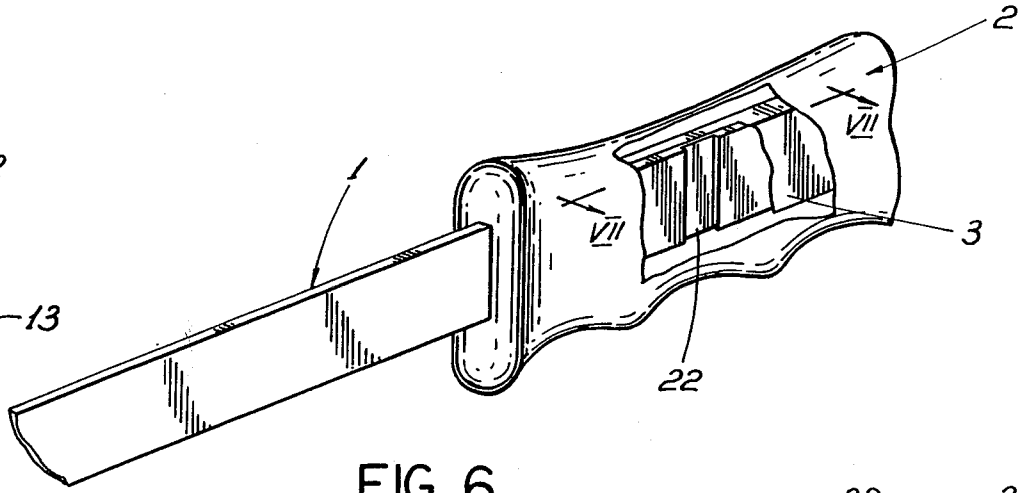
FIGS. 6 and 7 show a further optional feature that may be used as an alternative to that shown in FIGS. 4 and 5.
Figure 7:
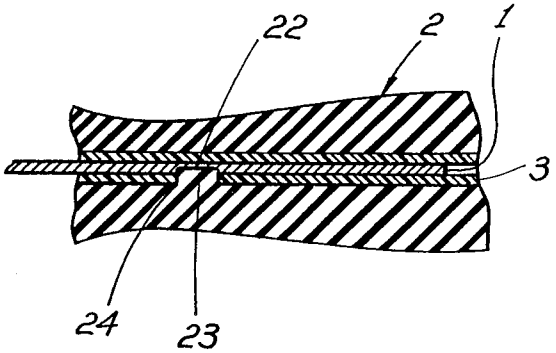

FIG. 6 being a partially cut away perspective of part of a knife and FIG. 7 being a cross section along the line VII—VII in FIG. 6.

Figure 1:
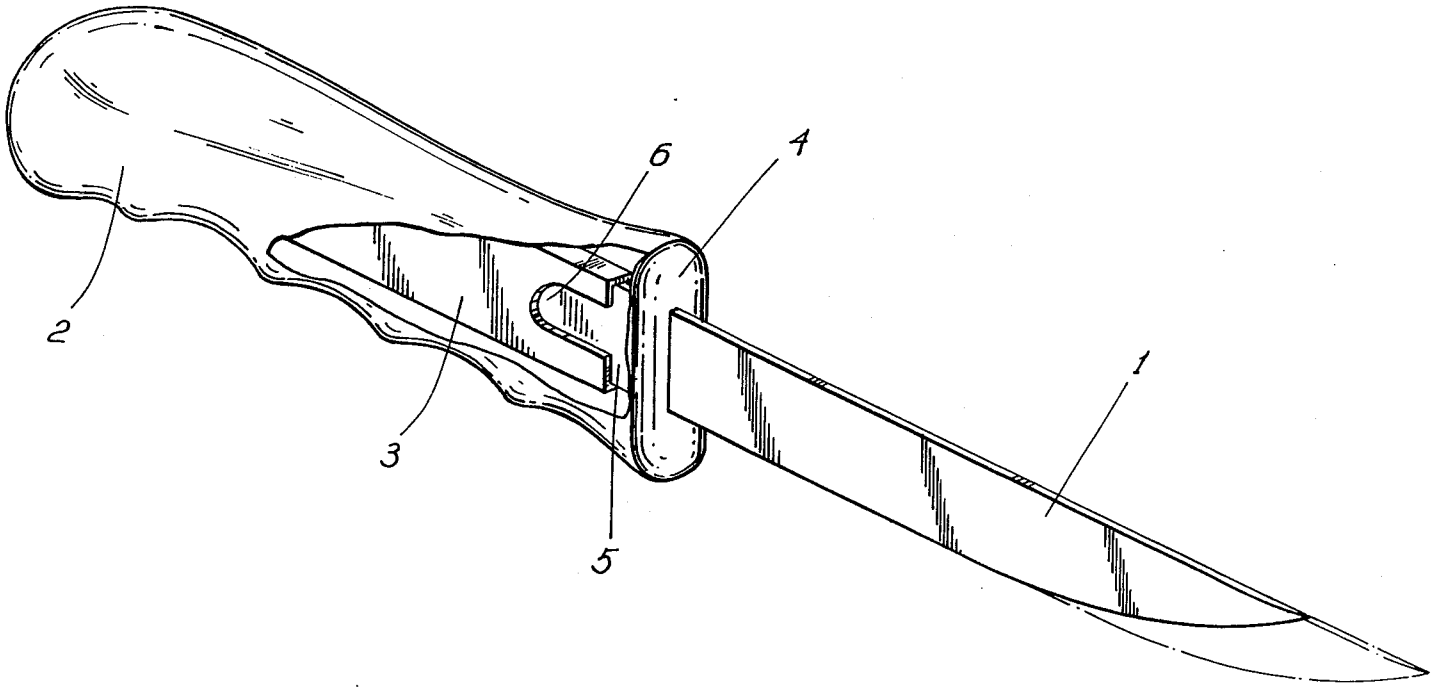
FIG. 1 is a perspective view, partially cutaway of a knife incorporating the basic features of the present invention.

Turning now to FIG. 1, this shows a knife having an adjustable blade length. It comprises a blade 1 that is mounted within and extending from a handle shown generally as 2. Within the handle is a sliding chamber 3 of relatively rigid, low coefficient of friction material such as a glass filled polyamide such as Zytel. The bulk of the handle is made of a deformable material having a high coefficient of friction, for example, a rubber such as that sold under the tradename Kraton. The sliding chamber does not extend all the way to the front edge 4 of the handle, but is disposed so that the blade will in all cases in a short region adjacent to the front of the handle 5 come into contact with the rubbery material of the bulk of the handle so that the blade is restrained by frictional contact with this rubbery material from slipping out of the handle accidentally. The sliding chamber is further provided with a cutout 6 so that when the handle is gripped, the rubbery material of the handle may be forced into contact with the blade or the tang of the blade in this region so as to increase the frictional force on the blade and hold it in position when the blade is in use. The blade length may be adjusted, for example, to a position such as is shown by the broken line simply by putting or pushing the blade relative to the handle at a time when no pressure is being exerted in the cutout area.

Figure 2:
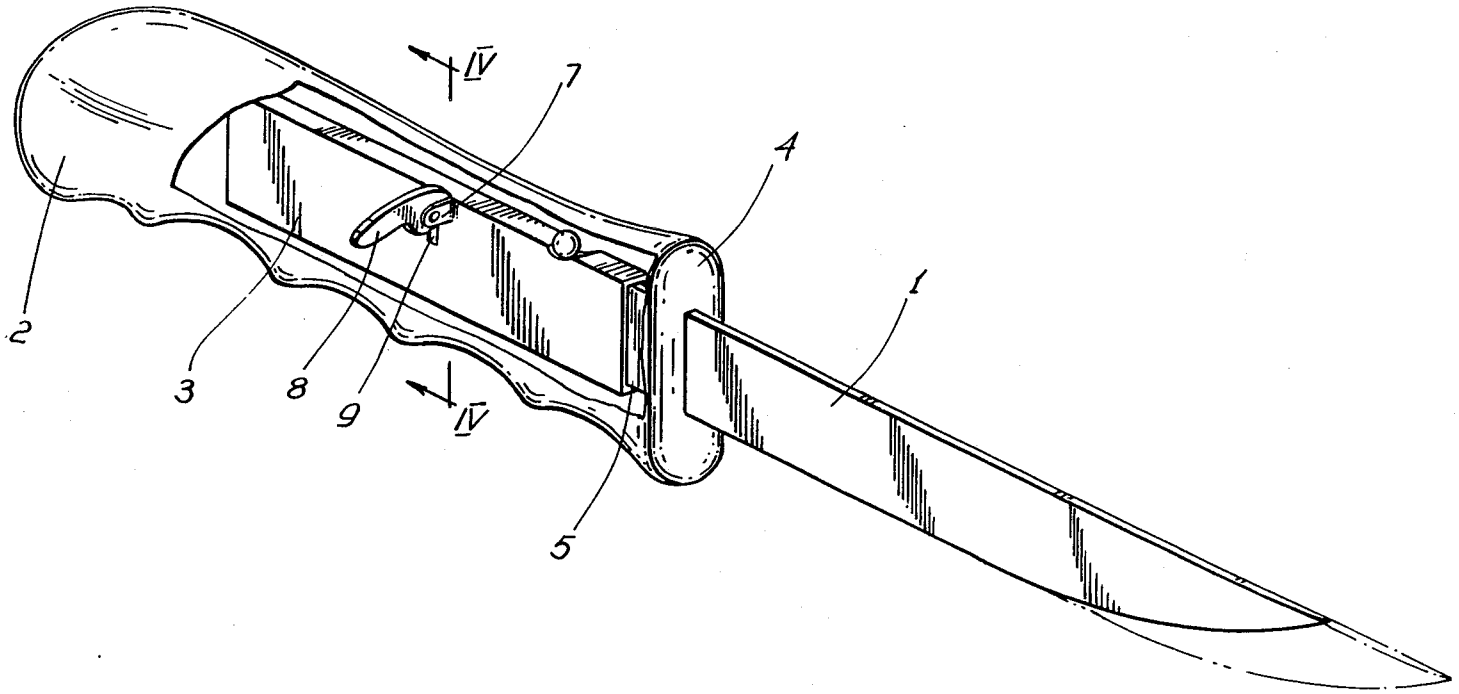
FIG. 2 is a perspective view, partially cutaway of a knife that forms a specific embodiment of the present invention, incorporating two optional additional features for assisting in holding the knife blade in position when in use.
Figure 3:
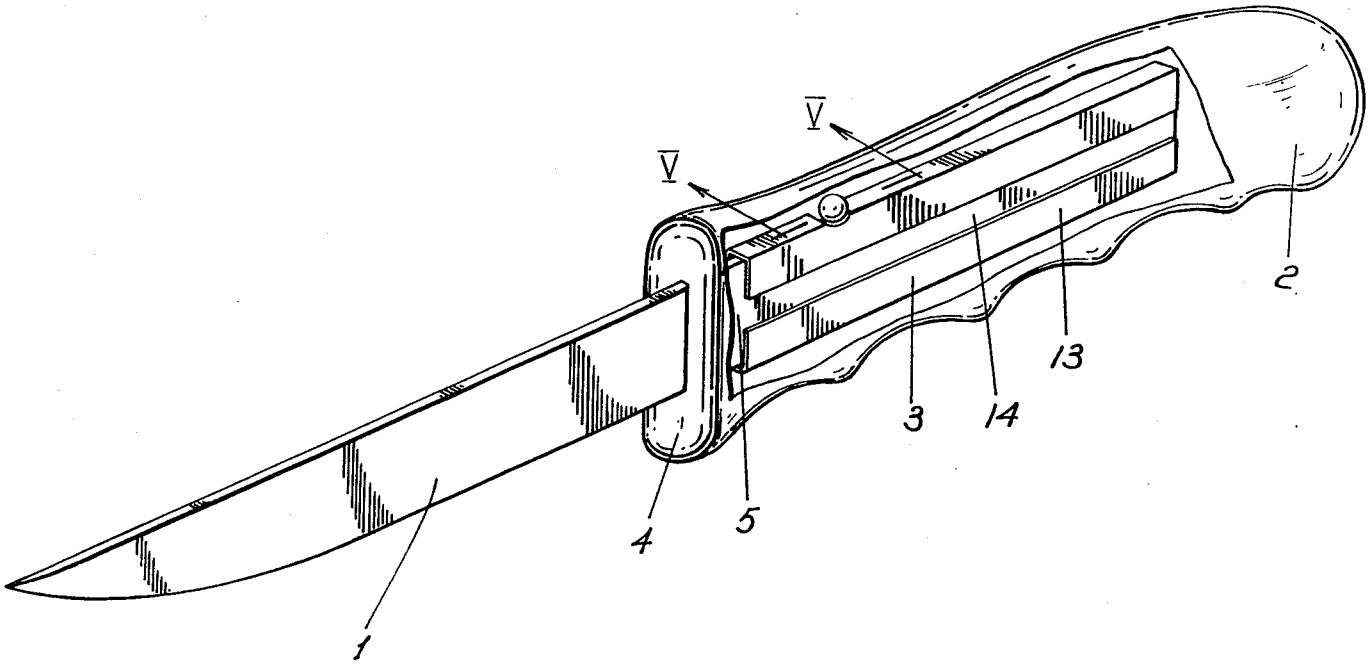
FIG. 3 shows the opposite side of the knife to that shown in FIG. 2.

FIGS. 2 and 3 show a modification of the knife shown in FIG. 1. Features 1, 2, 3, 4 and 5 in FIGS. 2 and 3 correspond to features shown in FIG. 1. In the embodiment of FIGS. 2 and 3, however, two supplementary blade restraining means are used. These features are optional so for as the basic inventive concept is concerned and may be used independently or together in a particular knife depending upon its intended use. Because of the slimy nature of fish, it is normally desirable that at least one of these features is present in a fish filleting knife.

Figure 4:
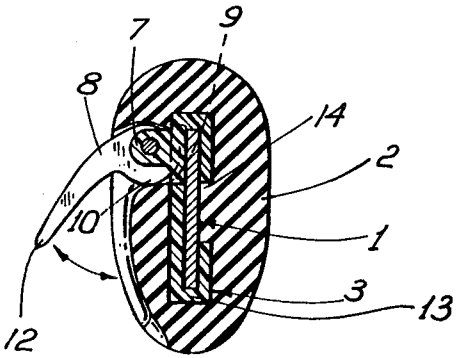
FIG. 4 is a cross-section view of a portion of the knife incorporating one such optional feature.

The first of the additional features is also shown in FIG. 4 which is a cross-section along the line IV—IV. The feature comprises a toggle 8 mounted on a pivoted mounting 7 that is molded with the sliding chamber 3. Adjacent to the toggle is a cutout 9 in the sliding chamber affording the base 10 of the toggle access to the blade 1. The base 10 of the toggle is shaped to act as a cam so that movement of the lever portion 2 of the toggle serves to urge the surface 10 into contact with the blade and force it against the opposite side of the sliding chamber, said opposite wall 13 of the chamber is itself provided with a cutout 14 through which the rubbery material of the handle 2 may contact the blade or its tang. When the toggle is moved to urge the blade into contact with wall 13, therefore, the blade is urged into contact with such rubbery high coefficient of friction material so as to secure it in place. The cutout 14 is shown as extending along the entire length of the sliding chamber 3. It will, however, be appreciated that this is not necessarily always the case and the cutout 14 may be localized to the region opposite the toggle 8.

Figure 5:
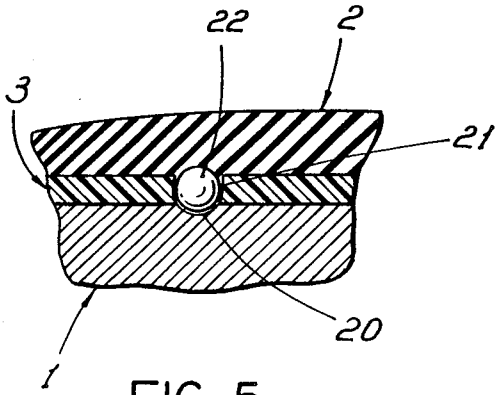
FIG. 5 is a cross-section view of a portion of the knife incorporating the other of such optional features.

The second optional feature that may be used to secure the position of the blade is to provide indents in one surface of the tang of the blade and cutouts in the sliding chamber in which ball bearings may be positioned in such a way that the blade tang is "locked" only when such a ball bearing corresponds in position to such an indent on the tang. This feature is shown in detail in FIG. 5 which is a cross-section along the line V—V of FIG. 3. Parts 1, 2 and 3 correspond to the parts shown in FIG. 1. In this case, however, the blade tang 1 has in its upper surface a small indent 20 and the sliding chamber has a cutout 21. In this cutout rests a ball bearing 22 which urged against the blade tang by the resiliency of the rubbery material of the handle 2. When in a "stable" position the ball bearing 22 rests in the indent 20. The indent is, however, of such a shape that when the blade is pushed or pulled the ball bearing is readily displaceable being pushed back against the resilient material of the handle. Provision of such a ball bearing and indent may, if the ball bearing is positioned close to the front end of the handle 4, provide a means for "reminding" users that if they extend the blade further, it will be pulled from the handle. However, provision of a number of such indents on the tang, and possibly more than one ball bearing may serve to define a number of "fixed" positions for the blade if this is desired. While FIG. 5 shows the positioning of a ball bearing on the top of the knife handle, it will be appreciated that a similar arrangement may be made with the ball bearing positioned to the side of the tang. In this case, there may be a hole cut all the way through the tang with which the ball bearing may co-operate to achieve a "locked" position.

FIGS. 6 and 7 show a modification of the expedient of FIGS. 4 and 5 wherein instead of there being an indent on the edge of the blade into which a ball bearing may fit, a groove 22 is milled across the flat of the blade and this can interact with a protruding portion 23 of resilient high coefficient material from the outer portion of the handle that protrudes through a cutout 24 in the sliding chamber 3.

We claim:

1. A knife having an adjustable blade length, said knife comprising a blade moveable within a handle within which handle is mounted a slide chamber the inner surfaces of which are, substantially flat, and have a coefficient of sliding friction with the blade below 0.35, said handle further comprising a portion made of a resilient deformable material having a coefficient of sliding friction with said blade of at least 0.55, said portion at least partially surrounding said sliding chamber and being disposed in such a way that when the handle is grasped said portion is urged toward said blade resulting in a contact being formed with said blade so as to hold said blade in any one of a number of positions of extensions in use.

2. A knife as claimed in claim 1 wherein said resilient deformable material is a thermoplastic rubber.

3. A knife according to claim 2 wherein said resilient deformable material is that sold under the trademark Kraton.

4. A knife according to claim 1 wherein said sliding chamber is formed of a glass fiber-filled polyamide resin.

5. A knife according to claim 3 wherein said sliding chamber is formed of a glass fiber-filled polyamide.

6. A knife according to claim 1 wherein said resilient deformable material has a coefficient of sliding friction with metal about 0.6 and the material of sliding chamber has a coefficient of sliding friction about 0.2 to 0.3.

7. A knife according to claim 1 wherein a portion of resilient deformable high friction material may be urged to contact the blade adjacent the front end of the handle.

8. A knife according to claim 1 wherein a portion of said resilient deformable material may be urged to contact the blade through one or more cutouts in the sliding chamber through which resilient deformable material may protrude.

9. A knife according to claim 8 wherein said resilient deformable material is that sold under the trademark Kraton and said sliding chamber is formed of a glass fiber-filled polyamide resin.

10. A knife according to claim 8 wherein a cutout in said sliding chamber is located opposite to a side-mounted toggle with a cam action that can urge the blade or its tang against said resilient deformable material protruding through said cutout.

11. A knife according to claim 1 wherein the tang of the blade has one or more indents that may cooperate with a ball bearing mounted in a cutout in the sliding chamber to provide for specific positions of extension for the knife blade.

12. A method for preparing a knife handle for use in a knife as claimed in claim 1 which comprises injection molding a resilient deformable material having a high coefficient of friction to surround a sliding chamber as defined in claim 1.

13. A variable blade length knife comprising (1) a blade member having a tang (2) a sliding chamber within which said tang may slide, said sliding member being made of a rigid material having a coefficient of sliding friction with said tang of less than 0.35

(3) a handle portion surrounding said sliding chamber and being shaped so as to be gripped by the user, said handle being injection molded around said sliding chamber and being formed of a resilient deformable material having a coefficient of sliding friction with the metal of the blade and tang of at least 0.55, said sliding chamber being provided with cutouts through which said resilient material may be urged into close frictional content with the tang.

14. A knife according to claim 13 wherein said urging of the blade or tang into contact with the resilient deformable material being effected by means of a side mounted toggle with a cam action.

15. A handle which comprises (1) a sliding chamber within which a tang of a tool may slide said sliding chamber being mounted in an interior cavity in said handle accessible by an aperture at one end of said handle and being made of a rigid material having a coefficient of sliding friction with said tang of less than 0.35, (2) a handle portion surrounding said sliding chamber and being so shaped as to be gripped by the user, said handle portion being injection molded around said sliding chamber and being formed of a resilient deformable material having a coefficient of sliding friction with said tang of at least 0.55, and (3) a side mounted toggle with a cam action, said toggle being moveable between open and closed positions, said sliding chamber being provided with cutouts through which said resilient deformable material may be urged into close friction contact with said tang by means of said side mounted toggle, said toggle being mounted in such a position that when it is in the closed position it urges close contact between a tang of any tool member present in said sliding chamber and said resilient deformable material in said handle

* * * * *